US005632392A

United States Patent [19]

Oh

[11] Patent Number: 5,632,392

[45] Date of Patent: May 27, 1997

[54] FOLDABLE CONTAINER

[76] Inventor: Hae Soon Oh, 122-5 Shinhung 2-dong, Sujung-gu, Sungnam city, Kyunggi-do, 461-194, Rep. of Korea

[21] Appl. No.: 505,263

[22] PCT Filed: Dec. 30, 1994

[86] PCT No.: PCT/KR94/00185

§ 371 Date: Nov. 15, 1995

§ 102(e) Date: Nov. 15, 1995

[87] PCT Pub. No.: WO95/18048

PCT Pub. Date: Jul. 6, 1995

[30] Foreign Application Priority Data

Dec. 30, 1993 [WO] WIPO ..... PCT/KR93/00125

[51] Int. Cl.[6] ..... B65D 25/00

[52] U.S. Cl. ..... 220/7; 220/6

[58] Field of Search ..... 220/7, 6, 684, 220/680

[56] References Cited

U.S. PATENT DOCUMENTS

| | | | |
|---|---|---|---|
| 3,987,945 | 10/1976 | McDowell | 220/7 |
| 4,940,155 | 7/1990 | Hewson | 220/6 |
| 5,125,524 | 6/1992 | Hosoda et al. | 220/7 |
| 5,195,644 | 3/1993 | Schmid | 220/7 |
| 5,279,438 | 1/1994 | Cesano | 220/7 |
| 5,282,542 | 2/1994 | Mo | 220/7 |

FOREIGN PATENT DOCUMENTS

| | | |
|---|---|---|
| 0091718 | 10/1983 | European Pat. Off. . |
| 3522511A1 | 1/1987 | Germany . |
| 5-40129 | 5/1993 | Japan . |

*Primary Examiner*—Joseph M. Moy
*Attorney, Agent, or Firm*—Banner & Witcoff, Ltd.

[57] ABSTRACT

A foldable container comprises a base (20), a first pair of opposing side walls (3,3') hingedly mounted at one pair of opposing edges of the base, a second pair of opposing side walls (2,2') hingedly mounted at one pair of opposing edges of the base and including flanges (7) extending from both side end regions of the second pair of side walls toward the first pair of opposing side walls, and connecting means for providing toothed engagements between the flanges of the second pair of side walls and the corresponding lateral end regions of the first pair of side walls in the standing-up position. The foldable container can be easily folded when empty and stand up with good stiffness when using.

13 Claims, 11 Drawing Sheets

FOLDABLE CONTAINER

TECHNICAL FIELD

The present invention relates to a foldable container, capable of being folded down compactly when empty.

BACKGROUND ART

A conventional transfortable container, which is typically used for containing and transporting materials, such as beverages, alcoholic liquors and fruits etc., requires much costs and spaces in transforting and storaging thereof due to maintaining the original volumn and shapes even when empty. Therefore, there have been proposed various kinds of foldable containers.

For example, DE 41 09 151 discloses a square, transportable container having a base onto which four side walls flap down when the container is empty. The first pair of facing side walls lie directly on the base and the second pair of opposite side walls rest on the first pair. The hinge axes of the side walls are positioned at different heights above the base. The side walls standed up are connected together by hook mechanism provided on them to form box shape of the container. The hook mechanism has disadvantages that locking and unlocking operation thereof is inconvenient and time-consuming and the cost therefor is relatively high.

Another fold able container is disclosed in EP 443 327 A2. This container has a construction basically similar to that of the container disclosed in DE 41 09 151, but the connection mechanism between adjacent side walls comprises L-shaped edge connecting elements of U-shape in section having fillets engaging with recesses on the top faces of the side walls. The connecting elements engage with both of the adjacent side walls to secure them integrally. However, because the connecting elements are separated from the container body, it is easy to miss the connecting elements when the container is folded down and the connecting using them is relatively inconvenient.

DISCLOSURE OF INVENTION

Accordingly, it is an object of the present invention to provide an improved foldable container which does not possess the disadvantages of the prior arts, but which provides better manipulatability of folding and unfolding and good stiffness in standing-up state.

In accordance with the invention, there is provided an improved foldable container comprising: a base having a substantially rectangular shape; a first pair of opposing side walls, which are hingedly mounted at one pair of opposing edges of the base to pivot between a folded position lying on the base and a standing-up position; a second pair of opposing side walls, which are hingedly mounted at one pair of opposing edges of the base to pivot between a folded position lying on the first pair of opposing side walls and a standing-up position and includes flanges extending from both side end regions of the second pair of side walls toward the first pair of opposing side walls; and connecting means for providing toothed engagements between the flanges of the second pair of side walls and the corresponding lateral end regions of the first pair of side walls in the standing-up position.

The connecting means may have protrusions on the first side walls and corresponding receiving recesses on the flanges engaging formfittingly each other to provide the toothed engagements. Preferably, the protrusions and receiving recesses engage each other wedgewisely to facilitate their engagements. The protrusions may have substantially trapezoidal shape or T-shapes in plan.

For maintaining the standing-up state of the container, provision may be made means for locking the engagements between the first pair of side walls and the second pair of side walls in the standing-up position. The locking means may comprise a pin passing through the protrusions and the flange engaged with the protrusions together. Alternatively, the locking means may advantageously comprise a stopper resiliently protruding on the inner surface of on the first pair of side walls to prevent the first pair of side walls from pivoting toward the folded position. Here, the stopper has an inclined surface for allowing the stopper to be retracted by contacting with the end edge of the second pair of side walls standing up.

The locking means may also comprise a pair of opposing stopper bars supported on the first pair of side walls in a laterally slidable manner and a spring interposed between facing ends of the stopper bars to resiliently urge the stopper bars toward the second pair of side walls. The second pair of side walls have a recess for receiving free ends of the stopper bars respectively. Here, it is preferable that the free ends of the stopper bars have an inclined surface in engaging direction of the first side walls for allowing said stopper bars to be retracted when said side walls are engaging each other.

There may be provided a lid for covering upper opening formed by the four side walls in the standing-up position. The lid may consist of two lid members, which are hingedly mounted on upper edges of one of pairs of side walls respectively.

For ensuring good stiffness in standing-up state of the container, provision is made a square rim for engaging upper edges of the four side walls in the standing-up position. Here, when the rim has sliding rails formed on opposed rim members along the first pair of side walls, and the second pair of side walls have arms hingedly mounted on both end regions of upper edges of the second pair of side walls and sliders fixed on free ends of the arms to be movable along the rails, the rim can be maintained integrally with the side walls in both folded and unfolded state.

Furthermore, there may be provided a lid for covering upper opening formed by the rim. The lid may be hingedly mounted on one of the rim members of the rim. The lid may be locked in closed position by locking means. The locking means may comprise a pair of opposing stopper bars supported on the lid in a laterally slidable manner and a spring interposed between facing ends of the stopper bars to resiliently urge the stopper bars, the rim members having a corresponding recess for receiving free ends of the stopper bars respectively.

BEST MODE FOR CARRYING OUT THE INVENTION

Figure 1:
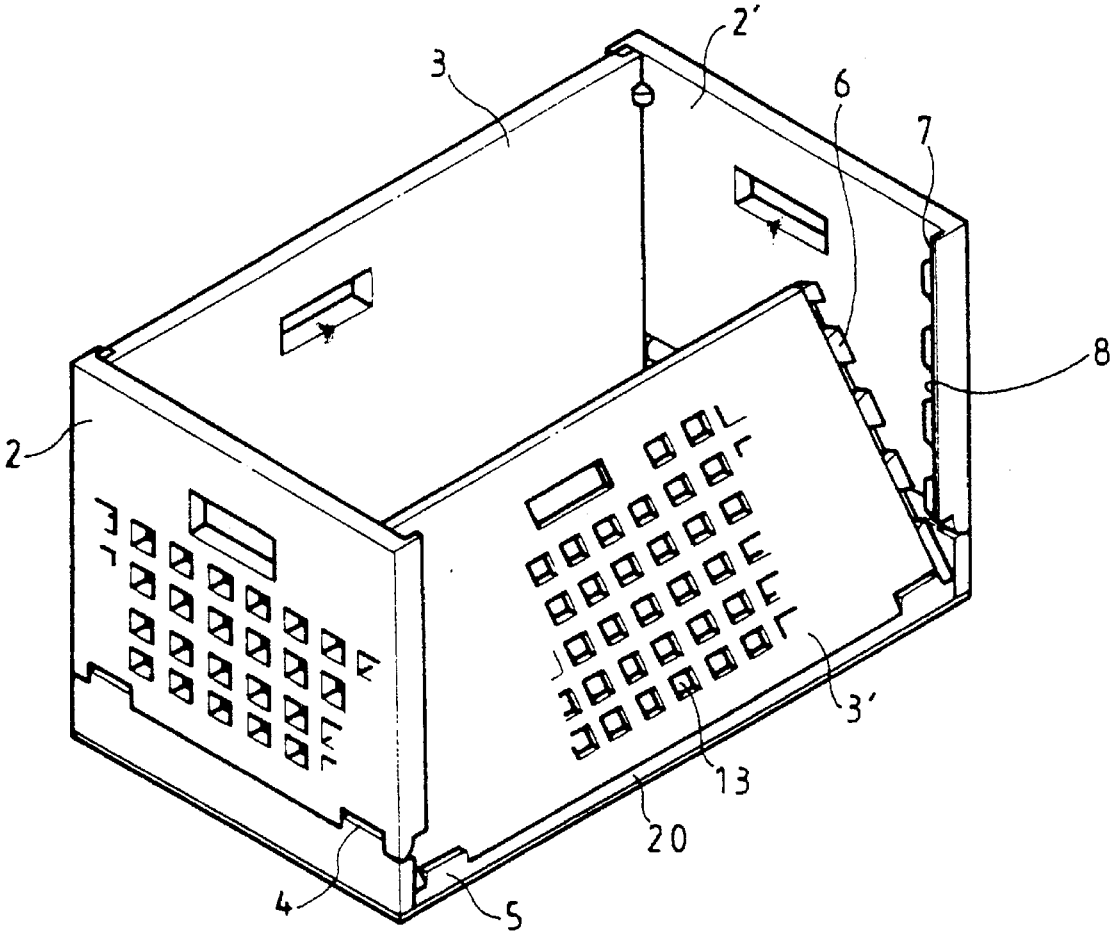
FIG. 1 is a perspective view of a foldable container according to the present invention.

Similar parts are given by identical reference numerals throughout the several examples and views of the drawing.

Figure 2:
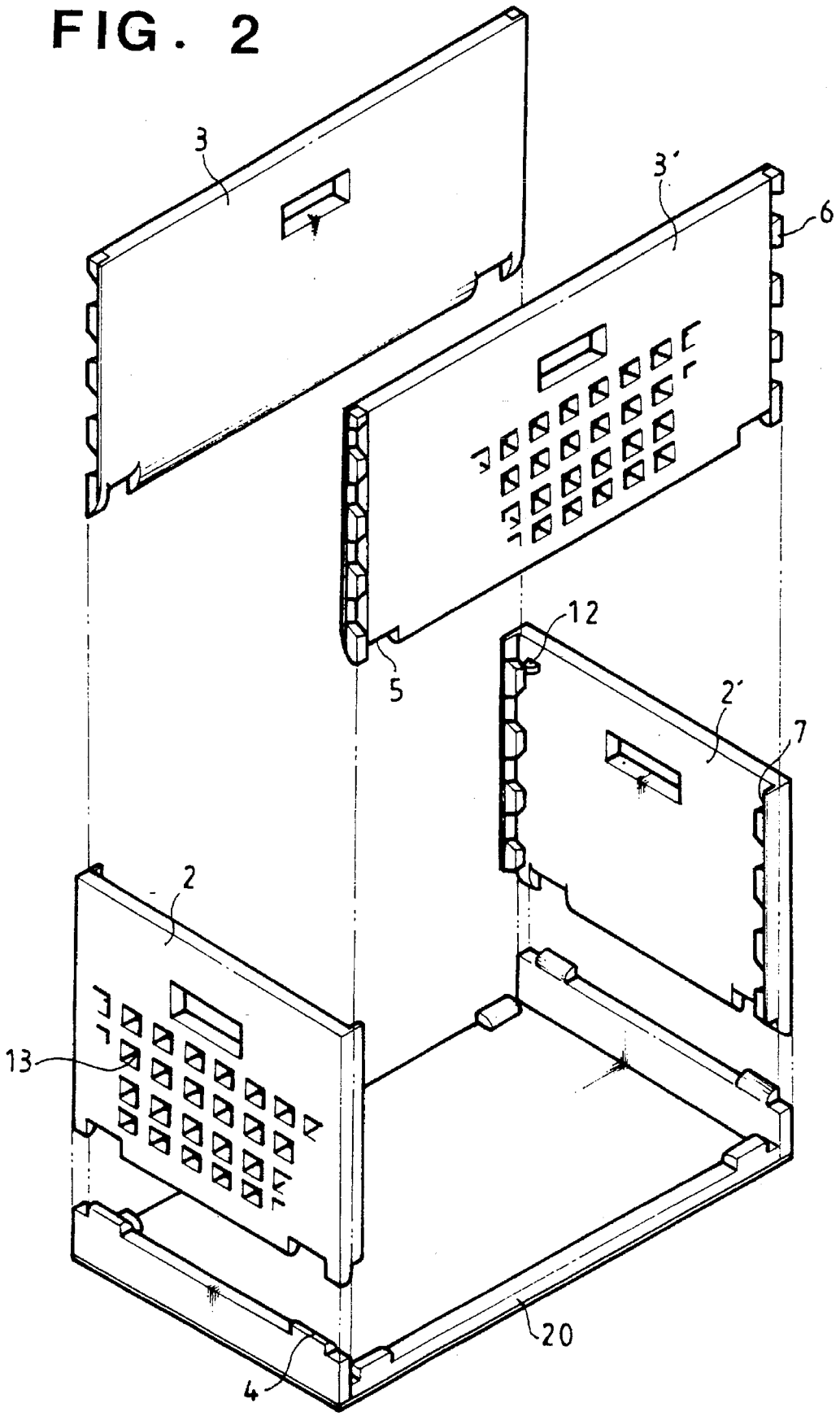
FIG. 2 is an exploded perspective view of the foldable container.

FIG. 1 is a perspective view of a foldable container according to the present invention, and FIG. 2 is an exploded perspective view of the foldable container. As shown in FIGS. 1 and 2, the foldable container according to the invention comprises a base 20 having a substantially rectangular shape and four side walls 2, 2', 3 and 3'. The side walls 2, 2', 3, 3' are hingedly mounted at four edges of said base by hinges 4 and 5 repectively. The long opposing side walls 2 and 2' can pivot between a folded position lying on said base and a standing-up position. The short opposing side walls 3 and 3' can folded down on said long opposing side walls foled on the base 20 to overlap thereon and can pivot to standing-up state as shown in FIG. 1. To ensure the overlapping of the side walls, the heights of hinge axes of the side walls can be designed to be different from each other.

Figure 4:
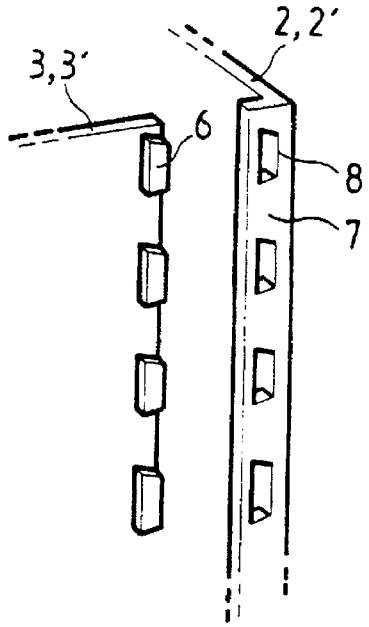
FIGS. 4 to 6 are views similar to FIG. 2 and show variant shapes of the engaging portion.
Figure 5:
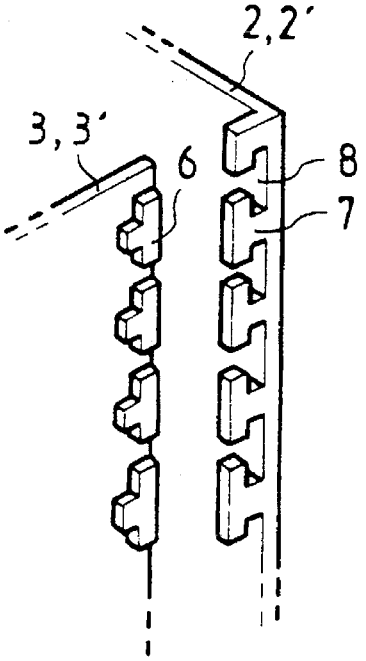
Figure 6:
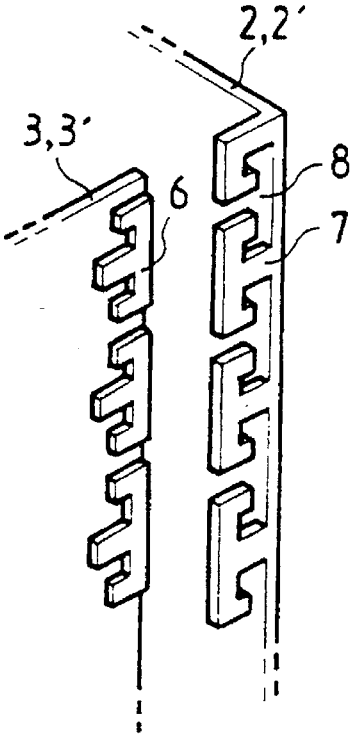

At both lateral end regions of the short side walls 2 and 2', there are provided flanges 7 extending toward the long side walls 3, 3'. The flanges 7 contact with lateral end regions of the long side walls 3, 3' to limit overpivoting of the side walls 3, 3'. Toothed engagements are made between the flanges 7 and the corresponding lateral end regions of said long side walls 3, 3' in the standing-up position. The toothed engagements can be obtained by protrusions 6 formed on the exterior surface of the lateral end regions of the long side walls 3, 3' and receiving recesses 8 formed correspondingly on said flanges 7 for receiving formfittingly said protrusions 6 in standing-up position of the side walls 2, 2', 3, 3'. To facilitate their toothed engagements, the protrusions 6 and the receiving recesses 8 have preferably inclied contact surfaces to engage each other wedgewisely as shown FIG. 1 and 2. Furthermore, to prevent the engagements of the side walls 2, 2', 3, 3' from separating in the longitudinal direction of the long side wall 3, 3', the protrusions 6 and the corresponding receiving recesses 8 may be formed to restrain the protrusions 6 in the recesses 8 as shown in FIG. 4. Alternatively, the protrusions 6 and the corresponding receiving recesses 8 may have substantially T-shapes in plan as shown in FIG. 5 and 6 or trapezoidal shape.

Figure 3:
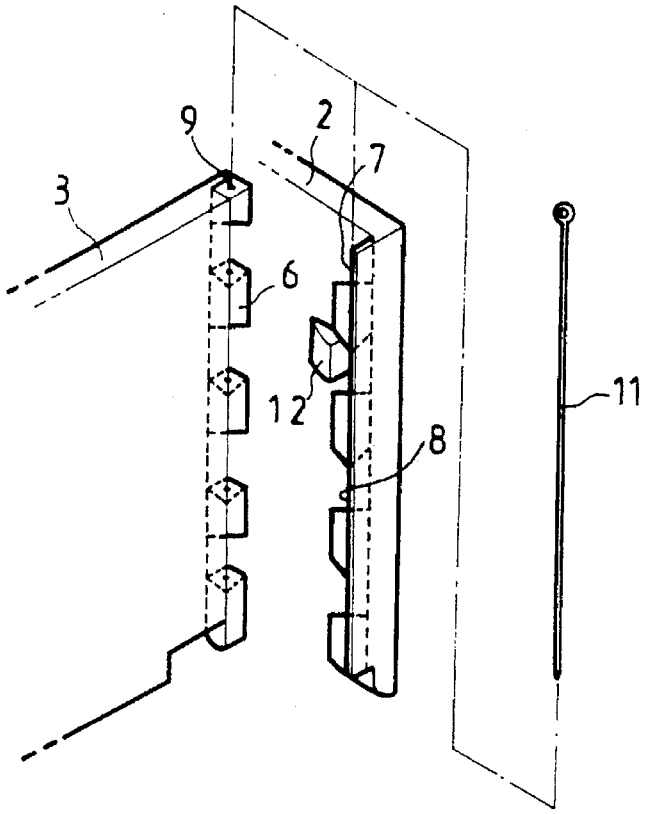
FIG. 3 is an enlarged perspective view of a engaging portion of side walls with two kinds of locking means.

FIG. 3 shows a pin 11 passing through the protrusions and the flange 7 engaged with the protrusions 6 all together, thereby to maintain the the engagement between the short side wall 2 and the long side wall 3 in the standing-up position. When the container is empty, the pin 11 is removed to allow the side walls 2 and 3 to be separated and folded down on the base 20.

Alternatively, as shown in FIG. 3, the engagement can be maintained by a stopper 12 protruding on the inner surface of the short side wall 2 and capable of being resiliently retracted by pressing. The stopper 12 has an inclined surface for allowing the stopper 12 to be retracted by contact with the end edge of the long side wall 3 during pivoting to standing-up position.

Figure 7:
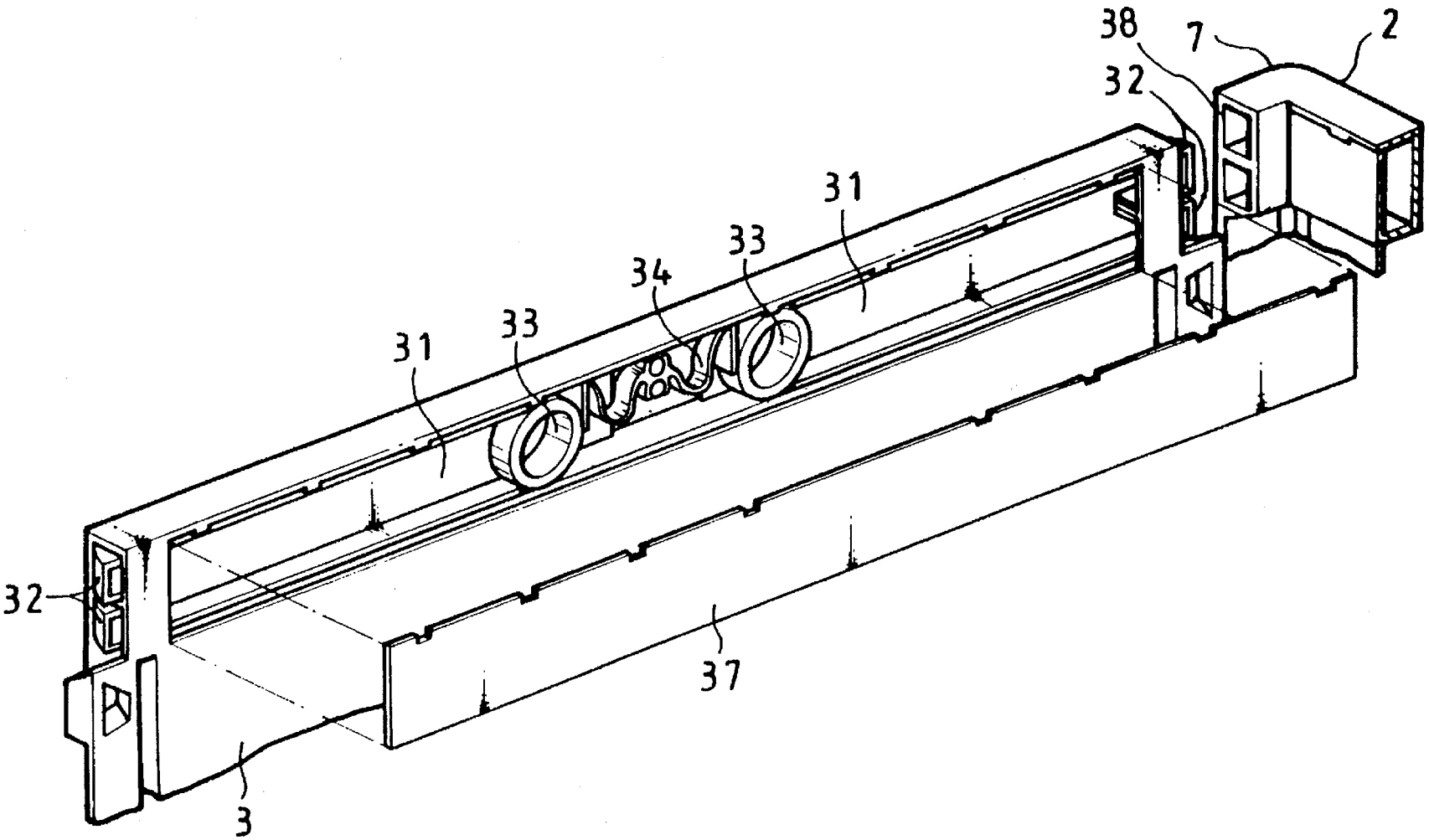
FIG. 7 shows a modification of the locking means in an partially exploded perspective view.
Figure 8:
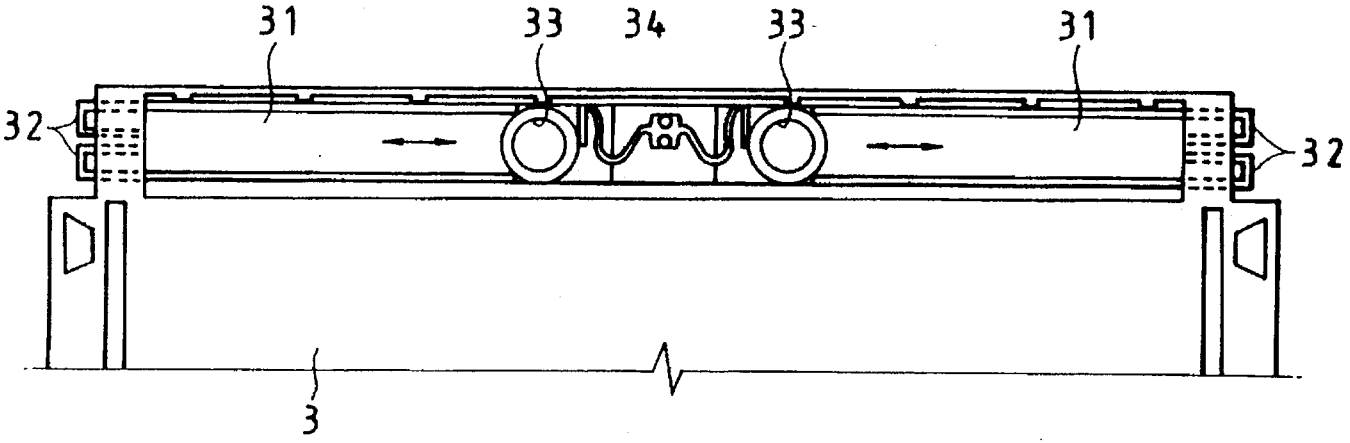
FIG. 8 is a front view of FIG. 7 without cover.
Figure 9:
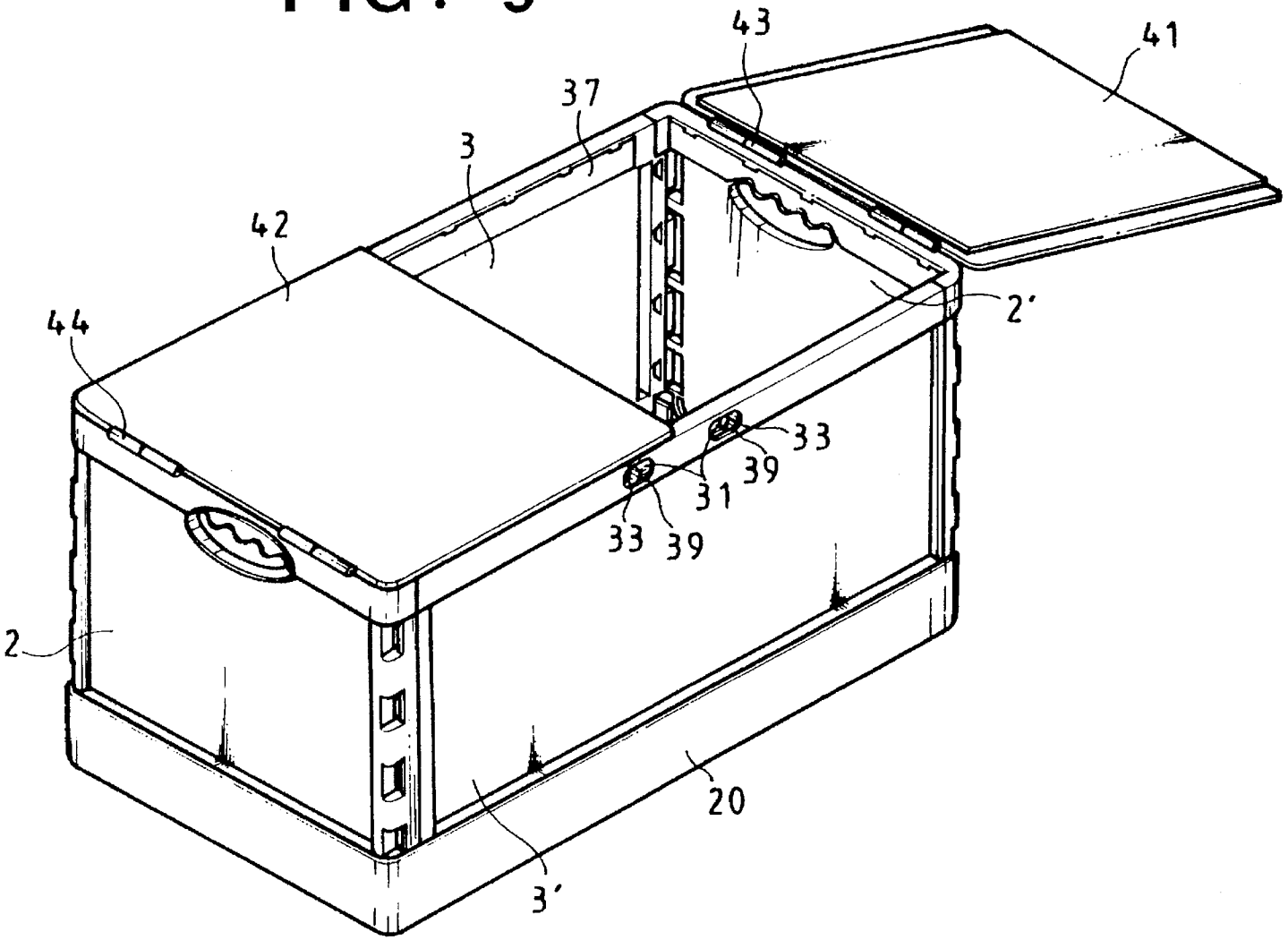
FIG. 9 is a perspective view of another container according to the invention having a lid.

As shown in FIG. 7 and FIG. 8, another locking means for maintaining the engagement between the side walls 2 and 3 can be made. FIG. 7 and FIG. 8 shows a pair of opposing stopper bars 31 supported at the free edge region of the long side wall 3 to slide along in a longitudinal direction of the edge. Between facing ends of the stopper bars 31, a spring 34 is interposed to resiliently urge the stopper bars 31 toward the both lateral ends of the long side wall 3. Free ends 32 of the stopper bars 31 can be resiliently protruded beyond the lateral edges of the side wall 3. Correspondingly, the short side wall 2 has recesses 38 for receiving the free ends 32 of the stopper bars 31. The stopper bars 31 have a finger recess 33 exposed from exterior respectively. An operator can thus retract the stopper bars 31 by making narrower his fingers inserted simultaneously in the finger recesses 33 through the slot 39 formed on the exterior surface of the side walls 3, 3' as shown in FIG. 9. Here, the free ends 32 of the stopper bars 31 have an inclined surface in engaging direction of the long side wall 3 for allowing the stopper bars 31 to be retracted by contacting with the edges of the flanges 7 when the side walls 2 and 3 are engaging. Reference numeral 37 is a cover for shielding the stopper bars 31 and the spring 34.

Figure 10:
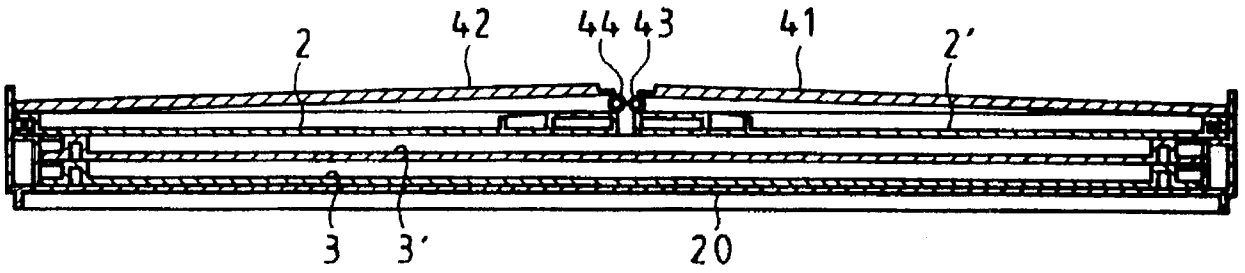
FIG. 10 is a sectional view of the container of FIG. 9 in folded down state.

FIG. 9 is a perspective view of another container according to the invention having a lid for covering upper opening formed by the four side walls 2, 2', 3, 3' in the using state. In the shown example, The lid consists of two lid members 41 and 42, which are hingedly mounted on free edges of short side walls 2 and 2' at hinges 43 and 44 respectively, thereby to pivot between a position covering the upper opening of the container and a position adjacent to the short side wall 2. FIG. 10 is a sectional view of the container in folded down state. The long side walls 3 and 3', the short side walls 2 and 2' and the lid members 21 and 42 in order are overlapped each other on the base 20.

Figure 11:
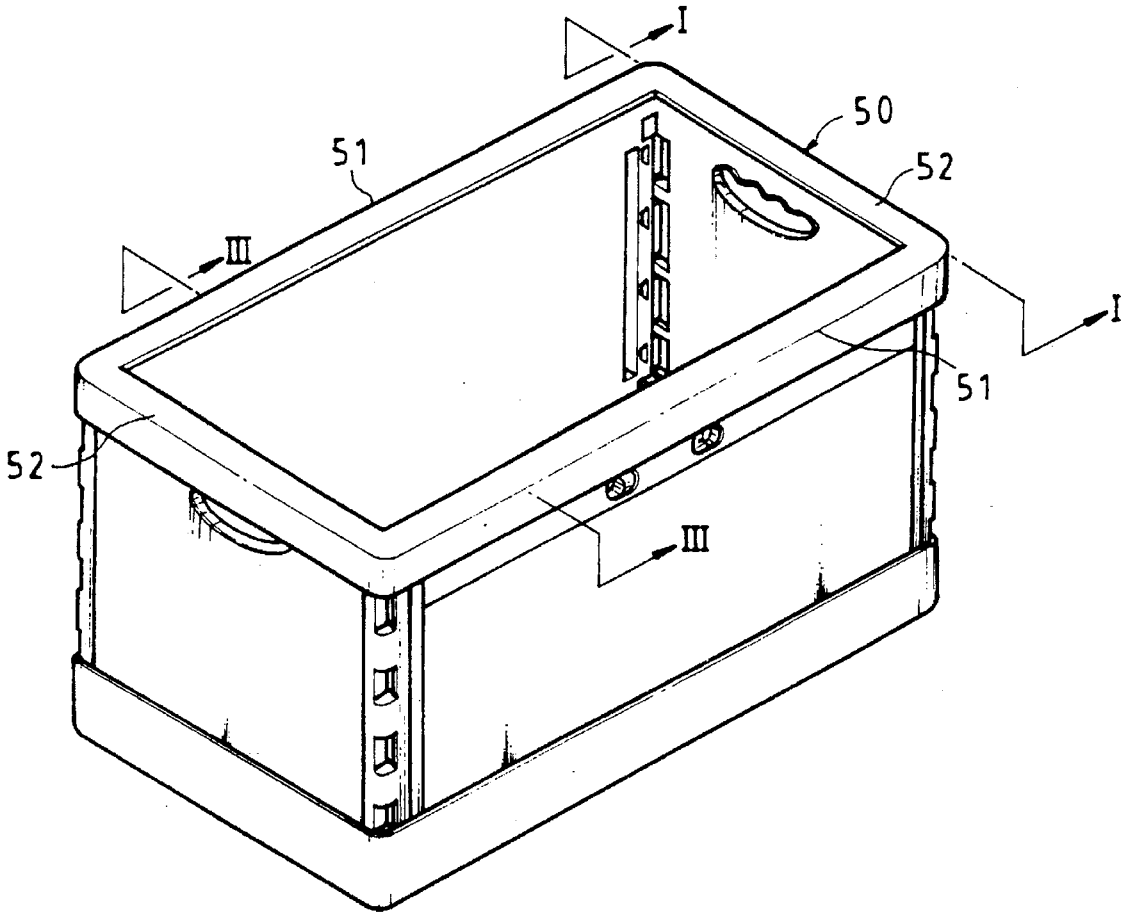
FIG. 11 is a perspective view of a further another container according to the invention having a rim.

FIG. 11 is a perspective view of a further another container according to the invention having a rim. The example has a square rim 50 for engaging upper edges of the four side walls 2, 2', 3 and 3' in the standing-up position. The rim 50 has four rim members 51, 52 and surrounds upper edges of the four side walls 2, 2', 3 to prevent a possible distortion of the side walls engaging each other. The rim 50 may be designed to be formfittingly inserted in the opening formed by the side walls in the standing-up position to attain the same purpose. When the container is folded down, the rim 50 can be removed from the side walls.

Figure 12:
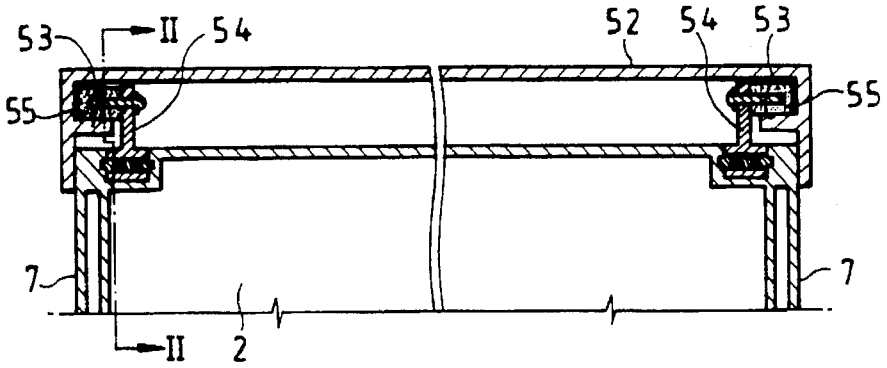
FIG. 12 is a section taken on line I—I in FIG. 11.
Figure 13:
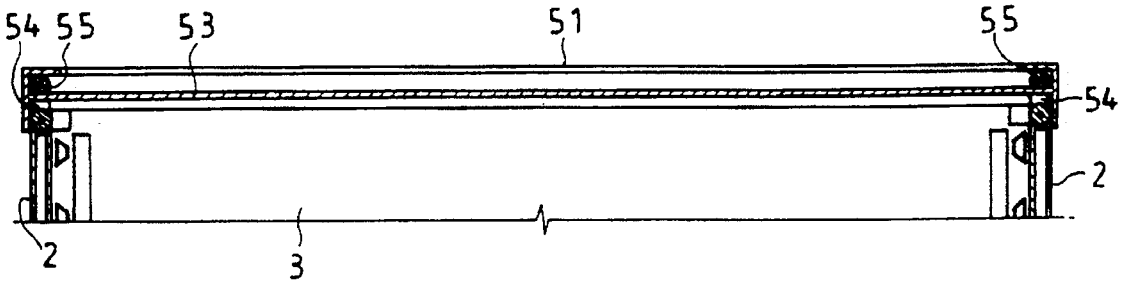
FIG. 13 is a section taken on line II—II in FIG. 12.

FIG. 12 is a section taken on line I—I in FIG. 11 and FIG. 13 is a section taken on line II—II in FIG. 12. These shows a possibility that the rim 50 can be folded down integrally with the side walls. The rim 50 has sliding rails 53 formed shelflikely on a pair of opposed rim members 51 along the long side walls 3, 3'. At the same time, the short side walls 2, 2' have arms 54 hingedly mounted on both end regions of upper edges of the short side walls 2, 2 and sliders 55 fixed on free ends of the arms 54. The sliders 55 are placed on the shelflike rails 53 to be movable along the rails 53.

Figure 14:
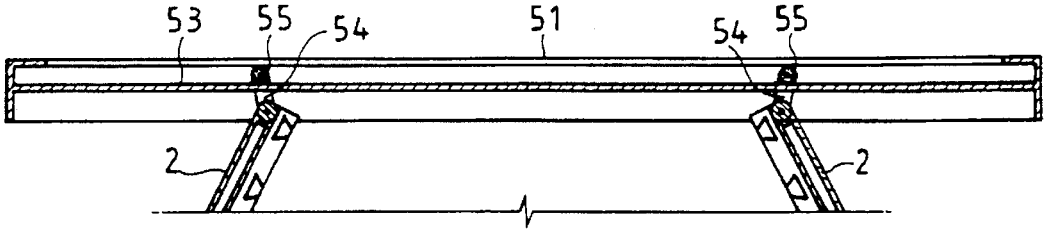
FIG. 14 illustrates an operation of FIG. 13.

When the short side walls 2, 2' pivots toward the base 20 after the long side walls 3, 3' have been folded down on the base, a pair of opposing sliders 55 on the rail 53 of one rim member 51 move toward each other as shown in FIG. 14 showing a similar section with FIG. 13. Accordingly, the rim 50 descents toward the base 20 together with pivoting of the side walls 2 and 2'.

Figure 15:
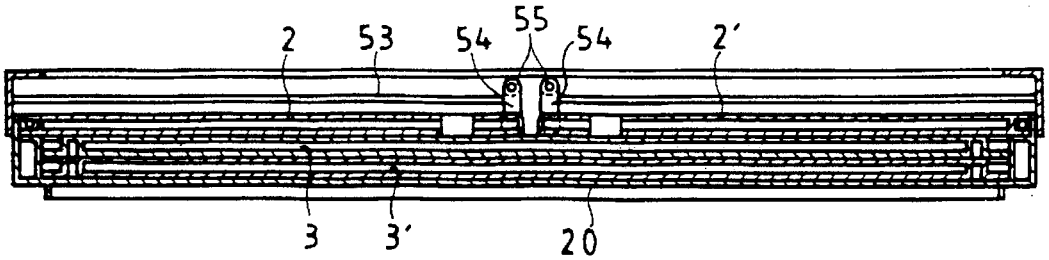
FIG. 15 is a sectional view of the container of FIG. 11 in folded down state.

FIG. 15 is a sectional view of the container in completely folded down state. As can be the seen in the figure, in the completely folded down state of the container, the rim is placed on the short side wall 2 and 2', which are overlapped on the long side walls 3 and 3' lying on the base 20.

Figure 16:
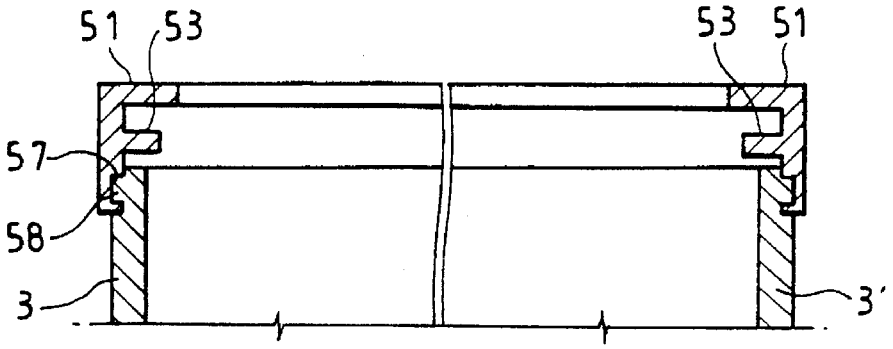
FIG. 16 is a section taken on line III—III in FIG. 11.
Figure 17:
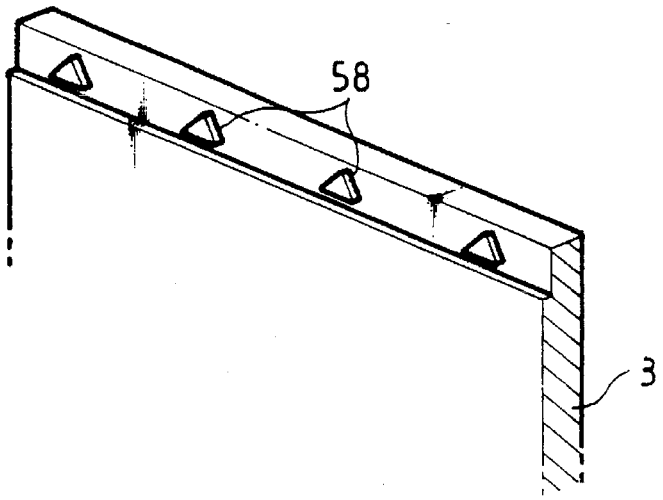
FIG. 17 is a fragmentary perspective view of the long side wall of FIG. 11.

FIG. 16 is a section taken on line III—III in FIG. 11. As shown in the figure, the side walls 3 and 3' and the rim member 51 engage each other by protrusions 58 formed on upper edges of the side walls 3 and 3' and recesses 57 formed on the skirt portions of the rim member 51, in the same manner with the protrusions 6 on the long side walls 3, 3' and the receiving recesses 8 on the flanges 7 of the short side walls 2, 2'. An example of the protrusions 58 is shown in FIG. 17 which is a fragmentary perspective view of the long side wall of FIG. 11. The recesses 57 receive the protrusions 58 formfittingly. The formfitting engagements by protrusions and recesses can be provided between the rim members 52 and side walls 2, 2'.

Figure 18:
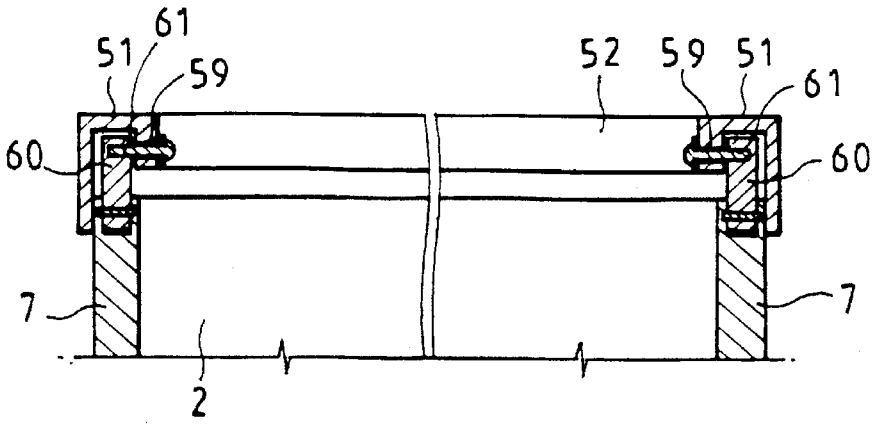
FIG. 18 is a modification of FIG. 12.

FIG. 18 shows a modification of FIG. 12. The opposing rim members 51 of the container according to FIG. 18 have a slot 59 formed longitudinally instead of the rail 53 of the FIG. 12. A slider pin 61 passes through the slot 59 to be fixed at free end of an arm 60, which is hingedly mounted on the upper end of the flange 7 of the side wall 2. Accordingly, when the short side walls 2, 2' pivots toward the base 20, a pair of opposing slider pins 61 in the slot 59 of one rim member 51 move toward each other, thus the. rim 50 descents toward the base 20 together with pivoting of the side walls 2 and 2'.

Figure 19:
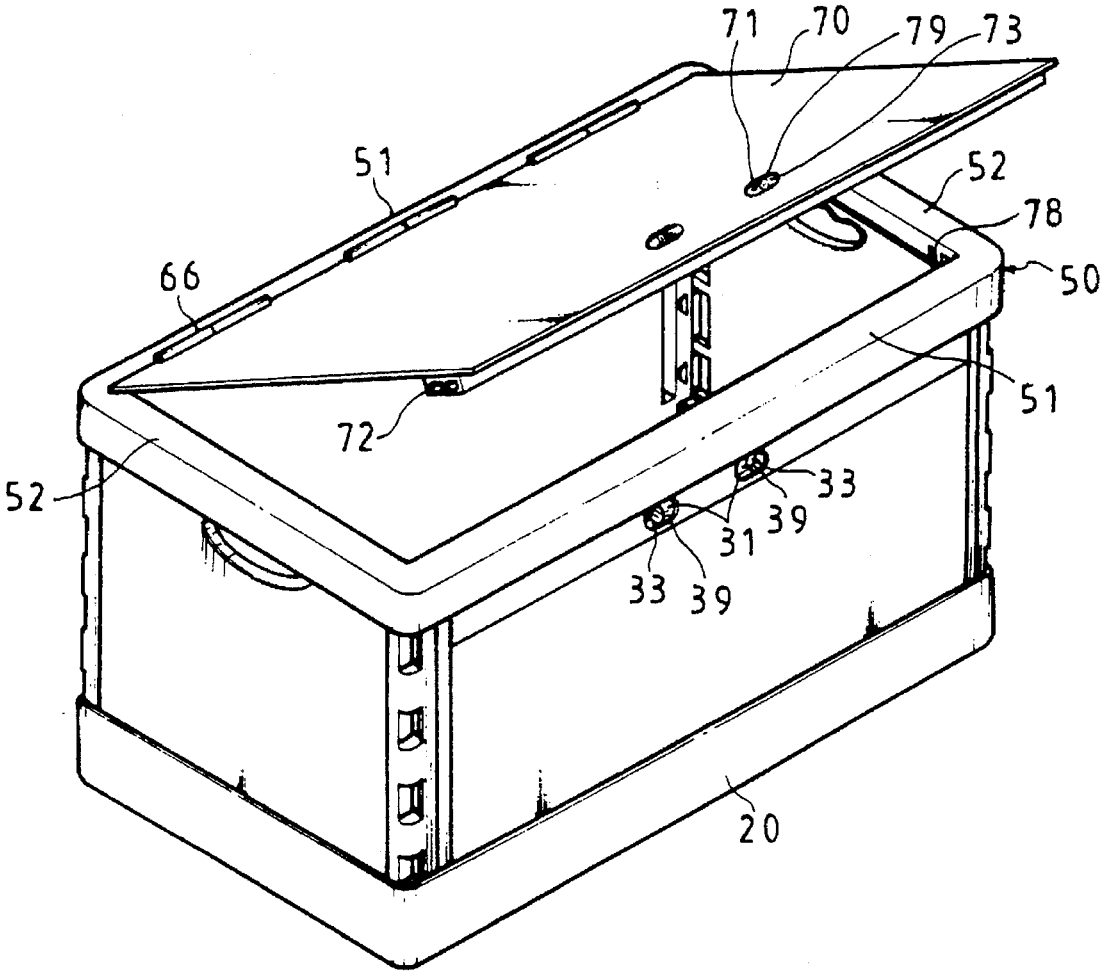
FIG. 19 is a perspective view of the container of FIG. 11 with a lid.

FIG. 19 is a perspective view of the container of FIG. 11 having a lid 70 additionally. The lid 65 covers upper opening formed by the rim 50. The lid 70 is pivotally mounted on one of the rim members 51 of the rim 50 by a hinge 66, so that it can pivot between a closed position and a opened position. The lid 70 has also locking mechanism similar to that of FIGS. 7 and 8. The locking mechanism comprises a pair of opposing stopper bars 71 in the lid 70 in a laterally slidable manner and a spring interposed between facing ends of the stopper bars to resiliently urge the stopper bars 71. Correspondingly, the rim members 52 have a corresponding recess 79 for receiving free ends 72 of the stopper bars 31 respectively.

As described above, the foldable container in accordance with the present invention can be easily folded when empty and stand up with good stiffness when using.

What is claimed is:

1. A foldable container comprising:

a base having a substantially rectangular shape;

a first pair of opposing side walls, which are hingedly mounted at one pair of opposing edges of said base to pivot between a folded position lying on said base and a standing-up position;

a second pair of opposing side wails, which are hingedly mounted at one pair of opposing edges of said base to pivot between a folded position lying on said first pair of opposing side walls and a standing-up position and includes flanges extending from both lateral end regions of said second pair of side walls toward said first pair of opposing side walls;

connecting means for providing toothed engagements between said flanges of said second pair of side walls and the corresponding lateral end regions of said first pair of side walls in the standing-up position, said connecting means having protrusions on said first side walls and corresponding receiving recesses formed on said flanges for receiving form fittingly said protrusions in standing-up position, said protrusions and said receiving recesses engaging each other wedge wisely; and means for locking the engagements between said first pair of side walls and said second pair of side walls in the standing-up position, said locking means comprises a pair of opposing stopper bars supported on said first pair of side walls in a laterally slidable manner and a spring interposed between facing ends of said stopper bars to resiliently urge said stopper bars toward said second pair of side walls having a recess for receiving free ends of said stopper bars respectively.

2. The foldable container according to claim 1, wherein said free ends of said stopper bars have an incline surface in engaging direction of said first side walls for allowing said stopper bars to be retracted when said side walls are engaging each other.

3. The foldable container according to claim 1, wherein said stopper bars can be retracted against said spring by manipulation from exterior.

4. The foldable container according to claim 2, further comprising a lid for covering upper opening formed by said four side walls in the standing-up position.

5. The foldable container according to claim 4, wherein said lid consists of two lid members, which are hingedly mounted on upper edges of one of pairs of side walls respectively.

6. The foldable container according to claim 2, further comprising a square rim for engaging upper edges of said four side walls in the standing-up position.

7. The foldable container according to claim 1, wherein said protrusions have substantially trapezoidal shapes in plan.

8. The foldable container according to claim 1, wherein said protrusions have substantially T-shapes in plan.

9. The foldable container according to claim 2, wherein said rim has sliding rails formed on opposed rim members along said first pair of side walls, and said second pair of side walls have arms hingedly mounted on both end regions of upper edges of said second pair of side walls and sliders fixed on free ends of said arms to be movable along said rails.

10. The foldable container according to claim 9, further comprising a lid for covering upper opening formed by said rim.

11. The foldable container according to claim 10, wherein said lid is hingedly mounted on one of the rim members of said rim.

12. The foldable container according to claim 11, further comprising means for locking the lid in a closed position.

13. The foldable container according to claim 12, wherein said locking means comprises a pair of opposing stopper bars supported on said lid in a laterally slidable manner and a spring interposed between facing ends of said stopper bars to resiliently urge said stopper bars, said rim members having a corresponding recess for receiving free ends of said stopper bars respectively.

* * * * *